US005143142A

United States Patent [19]

Imamura et al.

[11] Patent Number: 5,143,142

[45] Date of Patent: Sep. 1, 1992

[54] MOLD MAKING MACHINE HAVING VIBRATOR FOR REMOVING PATTERN PLATE FROM PREPARED MOLD

[75] Inventors: Nobuto Imamura; Jun Miyamoto, both of Aichi, Japan

[73] Assignee: Tokyu Co., Ltd., Japan

[21] Appl. No.: 709,159

[22] Filed: Jun. 3, 1991

[30] Foreign Application Priority Data

Jun. 6, 1990 [JP] Japan ..... 2-148151

[51] Int. Cl.[5] ..... B22C 19/06

[52] U.S. Cl. ..... 164/189; 164/182; 164/223

[58] Field of Search ..... 164/189, 182, 223, 260, 164/261, 44

[56] References Cited

U.S. PATENT DOCUMENTS 3,589,432 6/1971 Miller et al. ..... 164/189 X
4,411,303 10/1983 Shioda ..... 164/182
4,890,664 1/1990 Hunter ..... 164/182

FOREIGN PATENT DOCUMENTS 31184 1/1923 Denmark ..... 164/189
373149 4/1923 Fed. Rep. of Germany ..... 164/223

*Primary Examiner*—J. Reed Batten, Jr.
*Attorney, Agent, or Firm*—Parkhurst, Wendel & Rossi

[57] ABSTRACT

A mold making machine has a pattern plate and a pair of flasks which are superposed on each other such that the pattern plate is interposed between the two flasks. The pattern plate has an integrally formed pattern and cooperates with the flasks to define two mold cavities for forming two sections of a casting mold. The mold making machine includes at least one pattern-plate removing mechanism each of which has a vibrator which is supported by one of the two flasks such that the vibrator is movable in a direction in which the pattern plate and the flasks are superposed on each other. The mechanism further has a biasing member for biasing the vibrator against the pattern plate, so that the vibrator vibrates the pattern plate upon operation thereof, to thereby remove the pattern plate from the sections of the casting mold prepared.

10 Claims, 6 Drawing Sheets

MOLD MAKING MACHINE HAVING VIBRATOR FOR REMOVING PATTERN PLATE FROM PREPARED MOLD

BACKGROUND OF THE INVENTION

1. Field of the Invention

The present invention relates in general to a mechanism for vibrating a pattern plate to thereby remove the pattern plate from a mold formed by a mold making machine. More particularly, this invention is concerned with an improved pattern-plate removing mechanism which permits easy and fast changing of a pattern plate from one kind to another.

2. Discussion of the Prior Art

There is known a mold making machine adapted to compact a mass of sand within a molding flask, thereby preparing a casting mold. One type of this mold making machine uses a pattern plate and a pair of flasks (upper and lower flasks) which are superposed on each other such that the pattern plate is interposed between the flasks. The pattern plate has an integrally formed pattern and cooperates with the flasks to define upper and lower mold cavities, which are filled with sand to form upper and lower halves of a casting mold. The upper and lower flasks are then separated from each other while the pattern plate is removed from the prepared molds. Thus, the casting mold consisting of the upper and lower halves is prepared.

In the known mold making machine of the type indicated above, a vibrator is usually attached to the pattern plate, to oscillate or vibrate the pattern plate thereby removing the pattern plate from the prepared mold halves in the mold cavities, upon separation of the upper and lower flasks, while protecting the mold against chipping or other defects which may occur due to adhesion of the pattern of the pattern plate to the mold surfaces.

The pattern-plate removing mechanism using the vibrator directly attached to the pattern plate requires cumbersome and time-consuming changeover when the mold to be prepared by the mold making machine is changed from one kind to another. Namely, it is necessary to remove the vibrator from the pattern plate for one kind of mold, and attach the vibrator to another pattern plate for the new mold to be prepared. Thus, the known mold making machine using this mechanism for removing the pattern plate suffers from low production efficiency, particularly when the same machine is used to prepare different kinds of molds using different pattern plates.

To improve the production efficiency, it is proposed to attach an appropriate vibrator to the newly used pattern plate while another vibrator is used on the machine. However, this procedure requires two or more vibrators, inevitably resulting in an increase in the overall machine cost. Further, the above procedure still requires the attachment and removal of the vibrators to and from the pattern plates, which involve disconnection and re-connection of the vibrators to and from an electric or pneumatic power source. Thus, the proposed procedure still suffers from low efficiency of setup changeover for different kinds of molds.

SUMMARY OF THE INVENTION

The present invention was developed in view of the prior art situation described above. It is therefore an object of the present invention to provide a mold making machine including a mechanism for removing a pattern plate from a prepared mold, which mechanism permits fast and easy changing of the pattern plate from one kind to another, upon setup changeover of the machine for preparing a new mold, to thereby improve the production efficiency of the machine.

The above object may be achieved according to the principle of the present invention, which provides a mold making machine having a pattern plate and a pair of flasks which are superposed on each other such that the pattern plate is interposed between the two flasks. The pattern plate has an integrally formed pattern and cooperates with the pair of flasks to define two mold cavities for forming two sections of a casting mold. The present mold making machine is provided with at least one pattern-plate removing mechanism each of which includes (a) a vibrator supported by one of the pair of flasks such that the vibrator is movable in a direction in which the pattern plate and the flasks are superposed on each other, and (b) biasing means for biasing the vibrator against the pattern plate in the above-indicated direction, so that the vibrator vibrates the pattern plate upon operation thereof, to thereby remove the pattern plate from the sections of the casting mold prepared.

In the mold making machine of the present invention constructed as described above, the vibrator of the pattern-plate removing mechanism is attached to one of the pair of flasks. This arrangement eliminates the conventionally required removal and attachment of the vibrator each time the pattern plate is changed from one kind to another, due to change of the casting mold to be prepared. Accordingly, there is no need for electrical or pneumatic disconnection and re-connection of the vibrator when the pattern plate is changed. Thus, the pattern-plate removing mechanism of the present machine permits easy and fast changing of the pattern plate, without removing the vibrator, thereby assuring reduced non-productive time due to setup changeover for a new casting mold, and effectively improved mold making efficiency.

The present mold making machine is further advantageous in that the vibrator is supported by one of the flasks, movable in the direction in which the pattern plate and the flasks are superposed on each other. Namely, this arrangement is effective to reduce or prevent the transmission of the vibrations of the vibrator to the flasks during operation of the vibrator. Yet, the vibrations can be suitably transmitted to the pattern plate under the aid of the biasing means, which function to hold the vibrator in pressing contact with the pattern plate. As described above, the pattern-plate removing mechanism of the present mold making machine is capable of removing the pattern plate from the prepared mold with high efficiency, while effectively avoiding an adverse influence of the vibrations of the vibrator on the flasks to which the vibrator is movably attached.

BRIEF DESCRIPTION OF THE DRAWINGS

The above and optional objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

While this invention may take the form of various embodiments, there is schematically shown in FIGS. 1-5 one specific embodiment of a mold making machine, with the understanding that the present disclosure is not intended to limit the invention to the embodiment illustrated.

Figure 1:
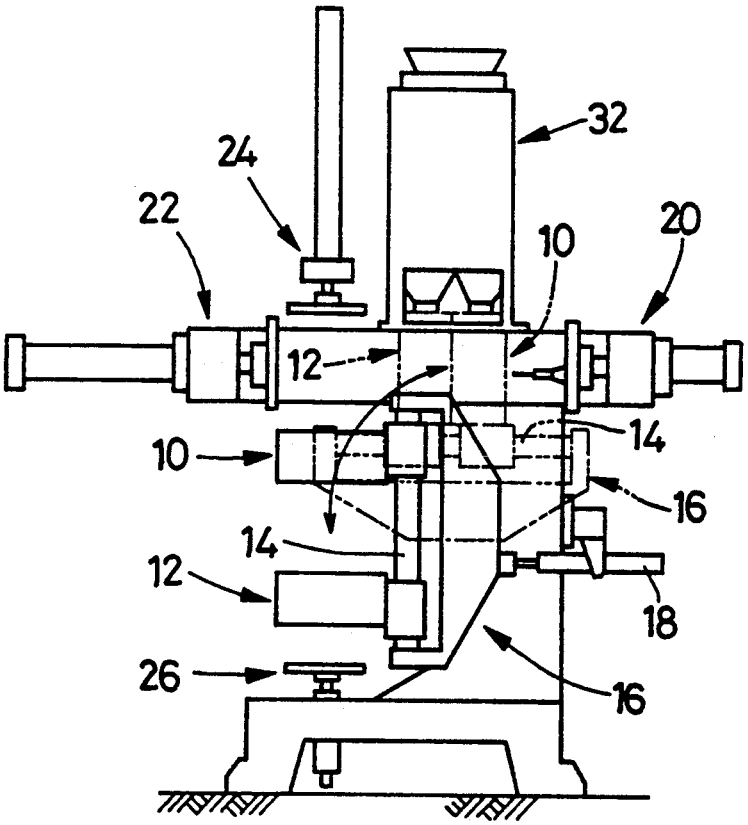
FIG. 1 is a schematic view showing one embodiment of a mold making machine of the present invention, which incorporates a mechanism for removing a pattern plate from a mold prepared by the machine.

Referring first to FIG. 1, reference numerals 10 and 12 denote a pair of flasks in the form of an upper flask and a lower flask, respectively. These flasks 10, 12 are supported by a guide bar 14 fixed on a support table 16 of the mold making machine. The flasks 10, 12 are movable on the guide bar 14, toward and away from each other in the longitudinal direction of the guide bar. The support table 16 is rotatable through about 90° by a cylinder 18, between a vertical position indicated in solid line in FIG. 1, and a horizontal position indicated in phantom line, in clockwise and counterclockwise directions as indicated by arrows in FIG. 1. The mold making machine further has a pair of squeezing devices 20, 22 which are disposed on opposite sides of the support table 16 in the horizontal position, so that the squeezing devices 20, 22 respectively act on the upper and lower flasks 10, 12 on the support table 16 in the horizontal position. Above the flasks 10, 12 on the support table 16 in the horizontal position, there is disposed a blowing device 32 which accommodates a mass of casting sand. Further, a mold removing device 24 and a mold receiving device 26 are disposed respectively above and below the upper and lower flasks 10, 12 on the support table 16 placed in the vertical position, so that the devices 24, 26 are aligned with the centerlines of the flasks 10, 12.

Figure 2A:
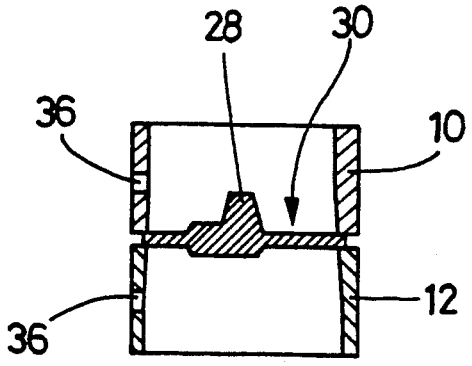
FIG. 2(*a*) through 2(*f*) are illustrations showing process steps for making a casting mold on the machine of FIG. 1.
Figure 2B:
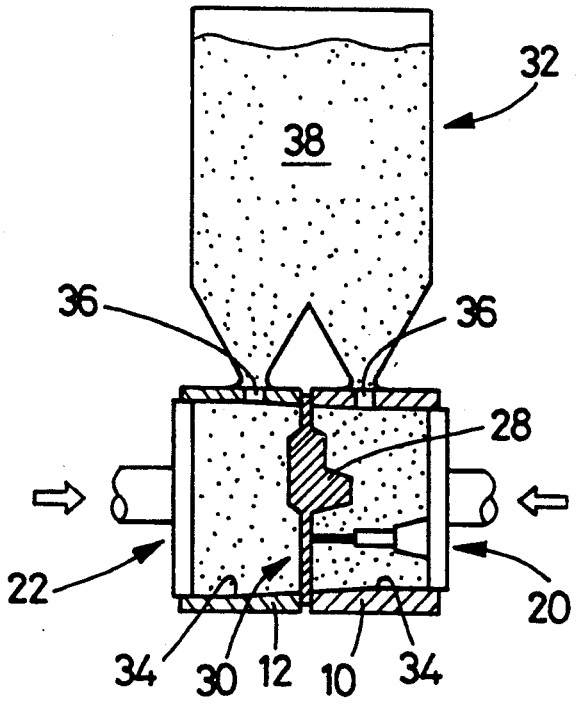
Figure 2C:
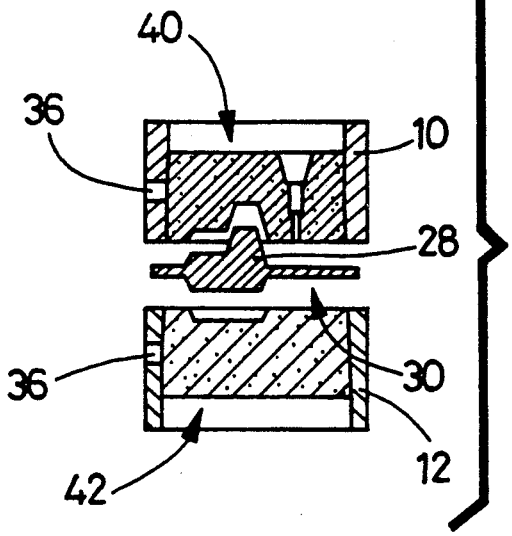
Figure 2D:
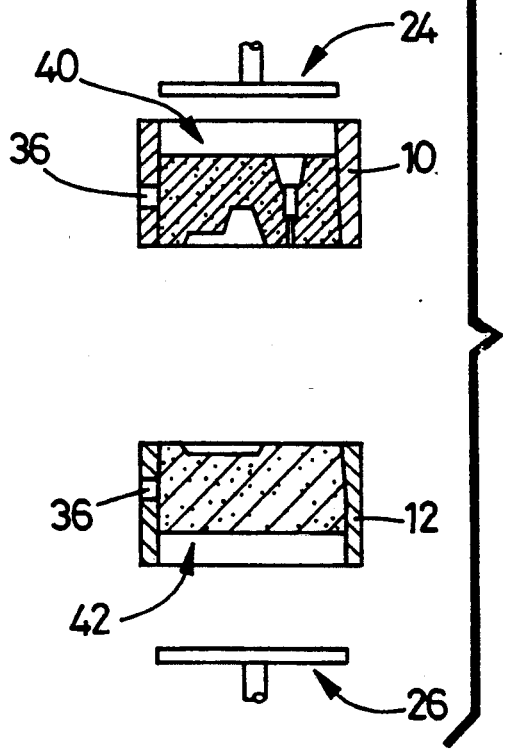
Figure 2E:
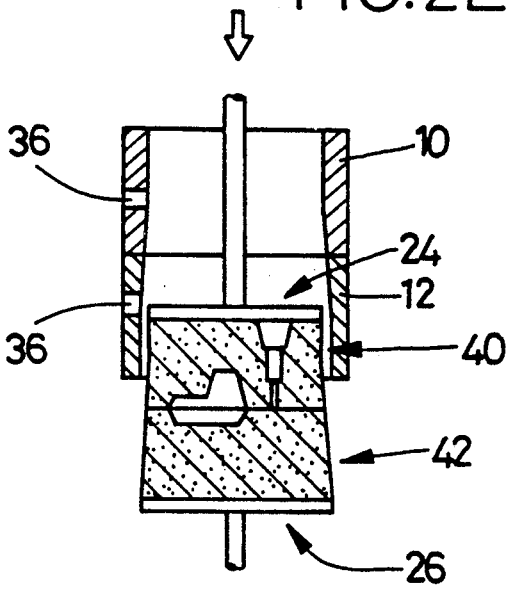
Figure 2F:
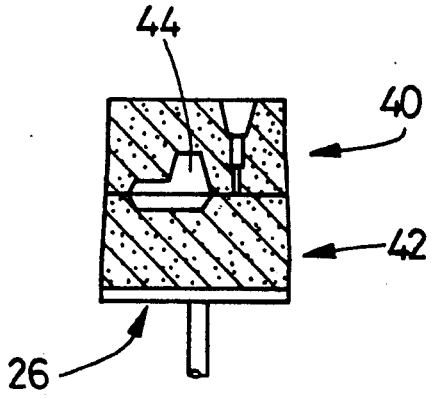

When the mold making machine constructed as described above is operated to form a casting mold, the support table 16 is initially placed in its vertical position indicated in solid line in FIG. 1. Then, a pattern plate 30 is inserted between the upper and lower flasks 10, 12, by a suitable device. The pattern plate 30 has a pattern 28 integrally formed on its central portion. The pattern 28 has a shape corresponding to a desired product to be produced by a casting mold which is prepared by the present mold making machine. With the pattern plate 30 placed between the opposed ends of the upper and lower flasks 10, 12, the flasks are moved toward each other so that the pattern plate 30 and the flasks 10, 12 are superposed on each other, with the pattern plate 30 sandwiched by and between the flasks 10, 12, as shown in FIG. 2(a).

Subsequently, the support table 16 is rotated to the horizontal position indicated in phantom line in FIG. 1, and the open ends of the upper and lower flasks 10, 12 are closed by flat plates of the squeezing devices 20, 22, as shown in FIG. 2(*b*), whereby two mold cavities 34, 34 are defined within the flasks 10, 12. These mold cavities 34 are filled with masses of sand 38 which are stored in the blowing device 32. The sand is introduced into the cavities 34 through feed holes 36, 36 formed through the cylindrical walls of the flasks 10, 12.

After the mold cavities 34 are filled with the sand 38, the masses of the sand 38 are compacted by the movements of the flat plates of the squeezing devices 20, 22, whereby upper and lower sections or halves 40, 42 of a desired casting mold are formed.

Then, the squeezing devices 20, 22 are moved away from the upper and lower mold halves 40, 42, and the support table 16 is rotated to the vertical position. The upper and lower flasks 10, 12 are then separated from each other, while at the same time the pattern plate 30 having the pattern 28 is removed from the upper and lower mold halves 40, 42, as indicated in FIG. 2(*c*). The removal of the pattern plate 30 is usually effected by suitable push mechanisms provided on the upper and lower flasks 10, 12, such that the pattern plate 30 is pushed away from the flasks 10, 12 by a suitable distance, so that the pattern plate 30 is removed from the upper and lower mold halves 40, 42, upon separation of the upper and lower flasks 10, 12 from each other.

After the pattern plate 30 is removed from between the flasks 10, 12, as indicated in FIG. 2(*d*), the flasks 10, 12 are butted together with the mold halves 40, 42 received therein. If necessary, suitable core or cores are positioned in a cavity eventually formed in the mold halves 40, 42, before the flasks 10, 12 are butted together. With the upper and lower mold halves 40, 42 superposed on each other, the mold halves 40, 42 are removed from the flasks 10, 12 by the mold removing device 24, while the superposed mold halves 40, 42 are supported by the mold receiving device 26, as shown in FIG. 2(*e*). Thus, the casting mold (40, 42) having the cavity 44 as shown in FIG. 2(*f*) is prepared by the present mold making machine.

Figure 3:
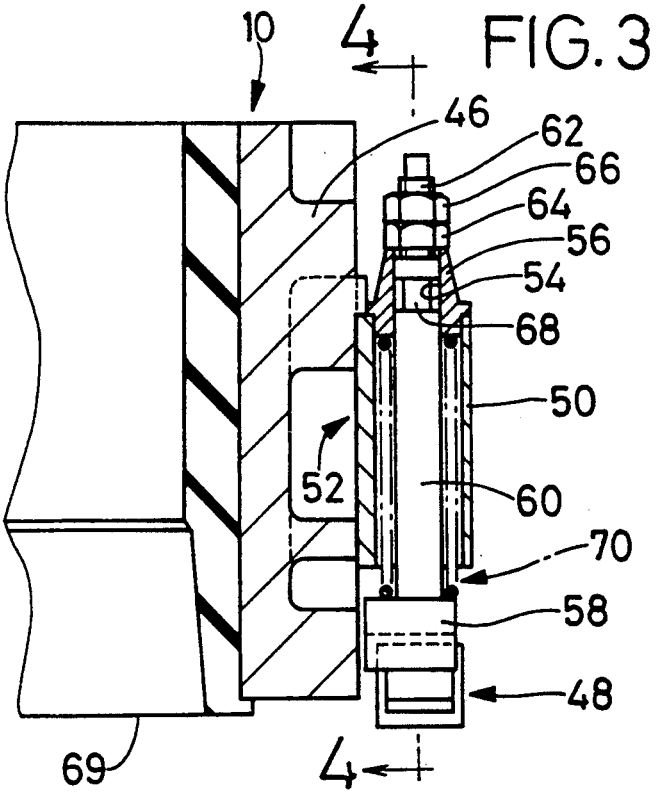
FIG. 3 is an elevational view in cross section of the pattern-plate removing mechanism used in the machine of FIG. 1.
Figure 4:
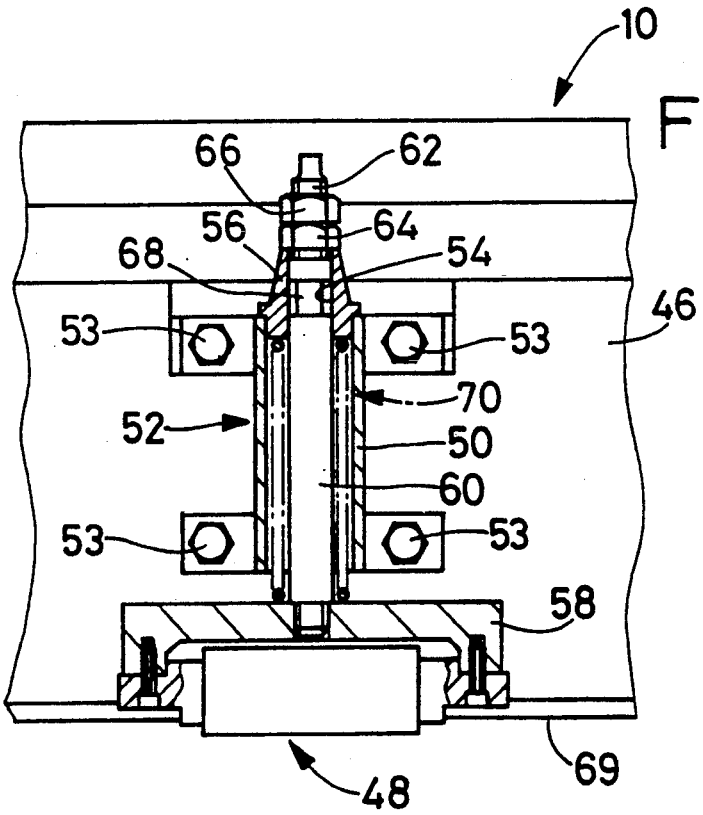
FIG. 4 is a cross sectional view taken along line 4—4 of FIG. 3.

To effectively remove the pattern plate 30 from the mold halves 40, 42, the present mold making machine employs a pattern-plate removing mechanism as shown in FIGS. 3 and 4, as well as the push mechanisms indicated above. In the present embodiment, this pattern-plate removing mechanism is attached to only the upper flask 10.

Described in greater detail, the pattern-plate removing mechanism includes a known vibrator 48 which is driven by a suitable power source such as compressed air or electromagnetic force. The vibrator 48 is connected to and supported by a mounting rod 60 through a bracket 58 which has a generally cup-shaped configuration as seen in FIG. 4. The vibrator 48 is accommodated in and secured to the bracket 58. The mounting rod 60 secured at one end thereof to the bracket 58 has an externally threaded end portion 62 remote from the bracket 58.

On the other hand, the upper flask 10 has a mount 52 fixed by bolts 53 to the outer surface of a portion 46 of the cylindrical wall of the upper flask 10. The mount 52 has a cylindrical support sleeve 50 which extends in the axial direction of the flask 10. The support sleeve 50 has a positioning sleeve 56 press-fitted in one end of its bore which is remote from a parting surface 69 of the flask 10 on the side of the lower flask 12, as viewed in the axial direction of the flasks 10, 12. The positioning sleeve 56 has a bore 54 whose diameter is smaller than that of the support sleeve 50.

The mounting rod 60 for the vibrator 48 extends through the support sleeve 50 and the positioning sleeve 56 such that the externally threaded end portion 62 is positioned outside the positioning sleeve 56. Nuts 64, 66 are screwed on the threaded end portion 62 of the rod 60, whereby the vibrator 48 secured to the rod 60 is attached to the upper flask 10 through the mount 52.

The mounting rod 60 is supported by the mount 52, such that the rod 60 slidably engages the bore 54 of the positioning sleeve 56, in concentric or co-axial relationship with the support sleeve 50. In this condition, the rod 60 is movable relative to the support sleeve 50 in the axial direction of the sleeve 50. In this respect, it is noted that the mounting rod 60 has a small-diameter portion 68 which is normally positioned within the bore 54 of the positioning sleeve 56. The small-diameter portion 68 is spaced away from the surface of the bore 54, so that the sliding resistance of the rod 60 with respect to the positioning sleeve 56 is reduced.

Within the bore of the support sleeve 50 of the mount 52, there is provided a coil spring 70 which is disposed around the circumferential surface of said mounting rod 60 and is compressed between the positioning sleeve 56 and the bracket 58 of the vibrator 48, in the axial direction of the sleeve 50. The coil spring 70 biases the mounting rod 60 through the bracket 58, in the direction toward the vibrator 48, whereby the end portion of the rod 60 on the side of the vibrator 48 projects out of the support sleeve 50.

The distance of projection of the mounting rod 60 from the support sleeve 50 is determined or adjusted by the position of the nut 64 relative to the externally threaded end portion 62 of the rod 60. In the present embodiment, the position of the nut 64 is adjusted so that the vibrator 48 projects a suitable distance from the parting surface 69 of the upper flask 10 in the longitudinal direction of the rod 60.

Figure 5:
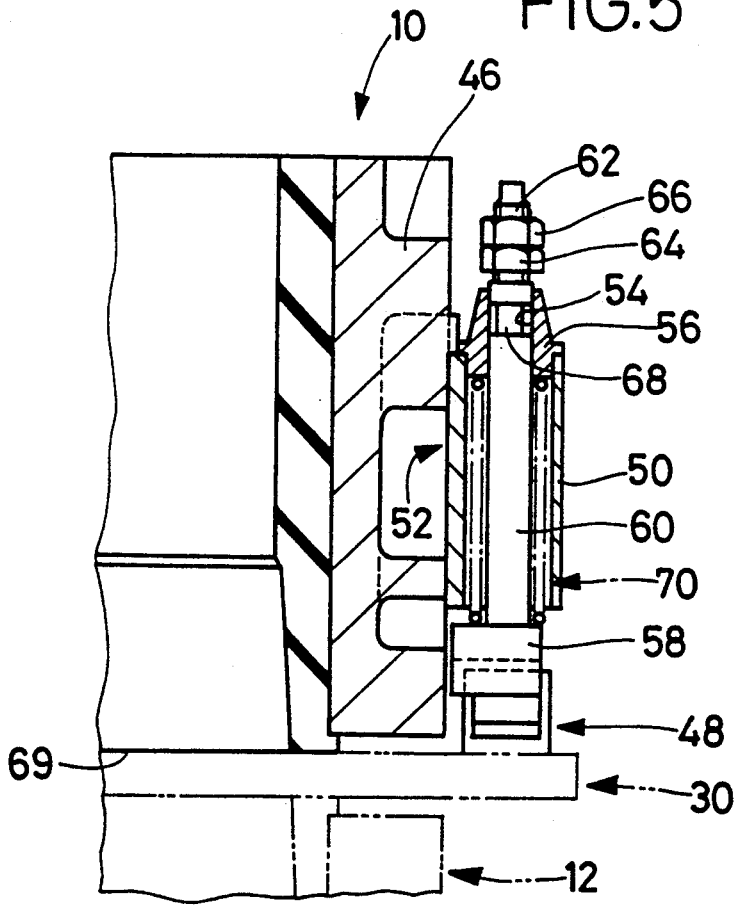
FIG. 5 is a cross sectional view showing the pattern-plate removing mechanism placed in a position different from that of FIG. 3.

When the pattern plate 30 and the upper and lower flasks 10, 12 are superposed on each other with the plate 30 interposed between the flasks 10, 12, the vibrator 48 attached to the upper flask 10 as described above is brought into abutting contact with the pattern plate 30, and is retracted by the plate 30 toward the support sleeve 50 against a biasing force of the coil spring 70, until the end face of the vibrator 48 is flush with the parting surface 69, as indicated in FIG. 5.

As the vibrator 48 is retracted, the mounting rod 60 is displaced from the position of FIG. 3 against the biasing action of the spring 70, whereby the nut 64 is spaced apart from the end of the positioning sleeve 56. In this condition, the rod 60 is reciprocable in the longitudinal direction relative to the mount 52, and therefore relative to the upper flask 10.

Further, the rod 60 is biased by the coil spring 70 toward the pattern plate 30, whereby the vibrator 48 connected to the end of the rod 60 is held in abutting contact with the pattern plate 30 under the biasing action of the coil spring 70.

When the vibrator 48 is activated while the pattern plate 30 and the upper and lower flasks 10, 12 are superposed on each other, the vibrating force of the vibrator 48 is effectively transmitted to the pattern plate 30, owing to the biasing force of the coil spring 70 which acts to bias the vibrator 48 against the pattern plate 30. However, the transmission of the vibrating force of the vibrator 48 to the upper flask 10 is restricted or prevented by the reciprocating displacement of the mounting rod 60 relative to the mount 52.

It will be understood that in the pattern-plate removing mechanism of the present mold making machine, the coil spring 70 serves as biasing means for biasing the vibrator 48 against the pattern plate 30, for maintaining the vibrator 48 in pressed abutting contact with the pattern plate 30.

According to the pattern-plate removing mechanism constructed as described above, the vibrator 48 is activated to vibrate the pattern plate 30, upon separation of the upper and lower flasks 10, 12 as shown in FIG. 2(*c*). As a result, the pattern plate 30 is easily removed from the upper and lower mold halves 40, 42, without damaging the mold halves, with the vibrations of the vibrator 48 effectively transmitted to the pattern plate 30, and to the pattern 28 formed with the plate 30. It is generally advisable that the vibrator 48 is de-activated immediately after the pattern plate 30 is completely separated from the mold halves 40, 42. This operation to de-activate the vibrator 48 may be effected manually by the operator of the machine, or automatically by using a limit switch adapted to detect the complete separation of the pattern plate 30.

In particular, the present pattern plate removing mechanism attached to the upper flask 10 need not be removed from and attached to the pattern plate 30, and does not require electrical or pneumatic disconnection and re-connection, even when the pattern plate 30 is changed from one kind to another for making a new casting mold. Accordingly, the setup changeover for different molds can be readily accomplished in a comparatively short time, leading to a considerably increased mold making efficiency of the machine.

It is also noted that the coil spring 70 not only serves to hold the vibrator 48 in pressed contact with the pattern plate 30 under a biasing action, but also serves to elastically yieldably support the vibrator 48 relative to the upper flask 10. The use of the single spring 70 for performing these two functions contributes to reduction in the number of components of the pattern-plate removing mechanism, and constructional simplification of the mechanism.

While the present invention has been described in its presently preferred embodiment for illustrative purpose only, it is to be understood that the invention is not limited to the details of the illustrated embodiment, but may be otherwise embodied.

For example, the structure for movably supporting the vibrator 48 relative to the upper flask 10 is not limited to that of the illustrated embodiment, but may be suitably modified.

More specifically, the coil spring 70 may be replaced by other biasing means such as belleville spring or coned disc spring, sheet spring or rubbery or elastic material.

Further, suitable means is provided to adjust the biasing force of the coil spring 70 which acts on the vibrator 48. For instance, the upper flask 10 may be provided with means for changing the relative position of the mount 52 and the upper flask 10. Alternatively, a suitable spacer may be provided between the positioning sleeve 56 and the corresponding end of the coil spring 70.

Although the illustrated embodiment is adapted such that the vibrator 48 biased by the spring 70 projects a suitable distance beyond the parting surface 69 of the upper flask 10, the vibrator 48 need not project beyond the surface 69 if the portion of the pattern plate 30 which contacts the vibrator 48 projects toward the upper flask 10.

While the pattern-plate removing mechanism including the vibrator 48 is attached to the upper flask 10 only, it may be attached to the lower flask 12 only, or two pattern-plate removing mechanisms may be attached to the upper and lower flasks 10, 12, respectively. Further, a plurality of such mechanisms may be attached to one or both of the flasks 10, 12.

Although the specific embodiment of the mold making machine according to the present invention has been described above, the invention is not limited to the illustrated embodiment, but the principle of the invention is equally applicable to various types of mold making machines, in particular, mold making machines adapted to prepare a casting mold used without flasks as indicated in FIG. 2(*f*).

It is to be understood that the present invention may be embodied with various other changes, modifications and improvements, which may occur to those skilled in the art, without departing from the spirit and scope of the invention defined in the following claims.

What is claimed is:

1. A mold making machine having a pattern plate and a pair of flasks which are superposed on each other such that said pattern plate is interposed between said flasks, said pattern plate having an integrally formed pattern and cooperating with said pair of flasks to define two mold cavities for forming two sections of a casting mold, said mold making machine comprising:

at least one pattern-plate removing mechanism each including a vibrator supported by one of said pair of flasks, and support means provided on said one of said pair of flasks, for supporting said vibrator such that said vibrator is movable in a direction in which said pattern plate and said pair of flasks are superposed on each other, said support means including (a) a positioning sleeve fixed to said one of said pair of flasks such that said positioning sleeve extends in said direction, (b) a mounting rod which is connected at one end thereof to said vibrator and extends through said positioning sleeve, and (c) biasing means defined by a coil spring disposed around said mounting rod and interposed between said positioning sleeve and said vibrator, said coil spring biasing said vibrator against said pattern plate in said direction, such that said vibrator is movable with said mounting rod being movable through said positioning sleeve, so that a vibrating force of said vibrator is transmitted to said pattern plate upon operation of said vibrator, to thereby remove said pattern plate from said sections of the casting mold prepared, and from said one flask, said support means preventing said vibrating force from being transmitted to said one flask.

2. A mold making machine according to claim 2, wherein said mounting rod has an externally threaded end portion remote from said one end, said externally threaded end portion being positioned outside said positioning sleeve, said support means further including a nut screwed on said externally threaded end portion of said mounting rod, said nut being held in abutting contact with said positioning sleeve under a biasing force of said coil spring acting on said mounting rod, when said one of said pair of flasks is spaced from each the other flask, said vibrator and said mounting rod being moved by said pattern plate, against said biasing force of the coil spring, whereby said nut is spaced apart from said positioning sleeve, when said pattern plate and said pair of flasks are superposed on each other.

3. A mold making machine according to claim 2, wherein said support means further includes a support sleeve disposed between said positioning sleeve and said vibrator and fixed to said one of said pair of flasks so as to extend in said direction, said positioning sleeve being secured to said support sleeve such that said positioning and support sleeves are co-axial with each other, said mounting rod extending through said support sleeve as well as said positioning sleeve.

4. A mold making machine according to claim 3, wherein said positioning sleeve has a bore having a diameter smaller than that of said support sleeve, said mounting rod slidably engaging said bore.

5. A mold making machine according to claim 4, wherein coil spring is at least partially received within said support sleeve.

6. A mold making machine according to claim 1, wherein said support means further includes a bracket through which said vibrator is connected to said mounting rod, said coil spring being interposed between said positioning sleeve and said bracket.

7. A mold making machine according to claim 1, wherein said vibrator projects a predetermined distance from a parting surface of said one of said pair of flasks, toward the other flask under a biasing action of said coil spring, when said pair of flasks are spaced apart from each other, said vibrator being moved by said pattern plate against the biasing action of said coil spring, when said pattern plate and said pair of flasks are superposed on each other.

8. A mold making machine according to claim 1, wherein said one of said pair of flasks is positioned above the other flask when said vibrator is activated to vibrate said pattern plate for removing said pattern plate from said sections of said casting mold.

9. A mold making machine according to claim 1, further comprising a support table which supports an assembly of said pattern plate and said pair of flasks, said support table being rotatable between a horizontal position in which said mold cavities are filled with a material forming said casting mold, and a vertical position in which said pattern plate is separated from said sections of said casting mold under the aid of said vibrator.

10. A mold making machine according to claim 1, wherein said at least one pattern-plate removing mechanism consists of one pattern-plate removing mechanism attached to one of said pair of flasks.

* * * * *